United States Patent [19]

Oliver

[11] Patent Number: 4,788,722

[45] Date of Patent: Dec. 6, 1988

[54] FABRIC FASHION ACCESSORY

[76] Inventor: Betty H. Oliver, 211 Pointer Dr., Manning, S.C. 29102

[21] Appl. No.: 164,953

[22] Filed: Mar. 7, 1988

[51] Int. Cl.[4] ..... A41D 23/00

[52] U.S. Cl. ..... 2/207; 2/243 B; 2/243 R

[58] Field of Search ..... 2/207, 206, 279, 243 R, 2/243 B, 244, 300, 144; 128/94

[56] References Cited

U.S. PATENT DOCUMENTS

| | | | |
|---|---|---|---|
| 2,112,774 | 3/1938 | Thorman | 2/207 |
| 2,413,318 | 12/1946 | Golfieri | 2/207 |
| 2,539,677 | 1/1951 | Teare | 128/94 |
| 2,568,826 | 9/1951 | Roussos | 2/91 |
| 2,574,678 | 11/1951 | Wilbur | 2/301 |
| 2,942,274 | 6/1960 | Ross | 2/91 |
| 3,080,566 | 3/1963 | Neumann | 2/91 |
| 3,260,292 | 7/1966 | Costello | 150/1.7 |
| 3,360,802 | 1/1968 | Kasamatsu | 2/207 |
| 3,605,121 | 9/1971 | Suzuki | 2/207 |
| 3,748,661 | 7/1973 | Smith | 2/207 |
| 4,277,849 | 7/1981 | Spears | 2/144 |

*Primary Examiner*—Werner H. Schroeder
*Assistant Examiner*—Jeanette E. Chapman
*Attorney, Agent, or Firm*—Benoni O. Reynolds

[57] ABSTRACT

A fabric fashion accessory and a method for making the accessory. The accessory, when completed by this method, is a two-ply triangle of material which can used either as a scarf or a sash. As the material is cut on a bias of approximately forty five degrees, the finished accessory is more stretchable and folds more gracefully than conventional scarves. In its finished state, the accessory has a right angle corner of 90 degrees, an acute corner of more than 45 degree but less than 90 degrees and a tapered corner of less than 45 degrees but greater than 0 degrees. Also the accessory has a finished vertical side, a finished diagonal side and a finished base side. The sides of the two-ply triangle of material are interwoven along the finished vertical side and finished base side and sewn along the finished diagonal side and along a seam which is at right angles to the finished diagonal side and extends to the right angle corner. The stitching is concealed by turning the two-ply triangle of material inside out subsequent to the stitching. The doubling of the material gives the accessory more body and the reversing of the material gives it a more finished look. The location of the seam permits the accessory to tie more easily and lay better, when tied, than conventional scarves.

7 Claims, 2 Drawing Sheets

FABRIC FASHION ACCESSORY

BACKGROUND OF THE INVENTION (1) Field of Invention

This invention relates to fabric fashion accessories. More particularly it relates to fabric scarves or belts and a method for making them.

(2) Description of the Prior Art

Most scarves of the prior art are horizontally cut and tend to pucker rather than lie gracefully around the neck of the wearer. Many are a single layer of material, have no body and lack a finished look. Other scarves have seams at the ends which makes the scarves difficult to tie and keeps the scarves from lying properly The shapes of the scarves make them difficult for left-handed people to tie. Also, the scarves of the prior art were not very stretchable because of the lack of a bias cut.

Conventional scarves are generally square and are folded over so that they may be placed around the neck. Thorman's Scarf of 1938 (U.S. Pat. No. 2,112,774) is one the early scarves adapted for multiple use, for example as a handkerchief and scarf. Goldfieri's Lady's Scarf of 1946 (U.S. Pat. No. 2,413,318) introduced the endless loop construction in a scarf which could be used as a scarf, head covering or a sash. Roussos's Garment Accessory of 1951 (U.S. Pat. No. 2,568,826) could also be used as a jabot or bustle. Ross's Scarf and Method for Forming Same of 1960 (U.S. Pat. No. 2,942,274) disclosed a scarf of dual-thickness construction having two square display panes connected by a neck strip. It could be used as a neck accessory or a scarf. Other convertible scarfs of the prior art are shown in Neumann (U.S. Pat. No. 3,080,566), Costello (U.S. Pat. No. 3,260,292), and Kasamatsu (U.S. Pat. No. 3,360,802).

Suzuki's Scarf Construction of 1971 (U.S. Pat. No. 3,605,121) discloses the joining of fabric panels at an angle to form a chevron configuration. Supposedly this construction made her scarf more versatile than the conventional square or triangular scarf. Lastly, Spears' Elongated Garment for Women and Girls of 1981 (U.S. Pat. No. 4,277,849) discloses a scarf having an intermediate section of constant width flaring out at each end to present different shapes. Again the object was versatility as opposed to an unique construction characteristics of the present invention.

Prior art known to this inventor includes the following U.S. Pat. Nos. 2,112,774, 3/1938, Thorman; 2,413,318, 12/1946, Goldfieri; 2,568,826, 9/1951, Roussos; 2,574,678, 11/1951, Wilbur; 2,942,274, 6/1960, Ross; 3,080,566, 3/1963,Neumann; 3,260,292, 7/1966, Costello; 3,360,802, 1/1968, Kasamatsu; 3,605,121, 9/1971, Suzuki; 4,277,849, 7/1981, Spears.

SUMMARY OF THE INVENTION

The present invention is a fabric fashion accessory, which functions as a scarf or sash, and a method for making this accessory. This method provides the unique characteristics in the finished fashion accessory by the relative dimensions of its sides, by the cutting of the material on a bias, by the location of the stitching, the use of dual layers of material and the reversal of the material surfaces in the finished product.

The method for making the fabric fashion accessory, for use as a scarf or sash, comprises the following eight steps:

First: cutting a trapezoidal piece of material having an upper portion, a lower portion, a top side, a vertical side having a vertical midpoint, a base side, and a first diagonal side having a diagonal midpoint. The top side and the vertical side meet at right angles to each other, forming a top corner; the vertical side and the base side meet at right angles to each other, forming a base corner; the base side and the first diagonal side meet at an angle of less than 90 degrees in relation to the base side, forming a lower corner; and the top side meets the first diagonal side at an angle of greater than 90 degrees in relation to the top side, forming an upper corner. The length of the top side is given in terms of the relative lengths of the first diagonal side and the base side by the formula: length of the top side equals the length of the first diagonal side minus the length of the base side.

Second: folding the lower portion of the trapezoidal piece of material, forwardly and upwardly, along an imaginary line drawn between the diagonal midpoint of the first diagonal side and the vertical midpoint of the vertical side, so that the base corner and the top corner are aligned, the top corner being behind the base corner the upper one-half of the vertical side is behind and aligned with the lower one-half of the vertical side.

Third: sewing the edges of the upper one-half and the lower one-half of the vertical side to each other.

Fourth: creating a second diagonal side by folding the trapezoidal piece of material so that the top corner and the base corner, sewn together in the preceding step, lie along the first diagonal side and parallel thereto thus forming a two-ply triangle of the material. The resulting two-ply triangle of the material has a right angle corner of 90 degrees, an acute corner of more than 45 degrees but less than 90 degrees, and a tapered corner of less than 45 degrees but greater than 0 degrees.

Fifth: sewing the edge of the first diagonal side to the edge of the second diagonal side from the tapered corner to the acute corner, leaving an opening approximately one-inch in length in the sewing, the opening to be located about five inches from the tapered corner.

Sixth: turning the two-ply triangle of material inside out by pulling the interior of the fabric fashion accessory through the opening left in the sewing in the previous step, to conceal the sewn edges of the first diagonal side and second diagonal side and of the lower one-half and the upper one-half of the vertical side.

Seventh: stitching closed the opening previously left in the sewing in the fifth step above.

Eighth: pressing the two-ply triangle of material at a pressing iron temperature suitable for the particular fabric being used to make the fabric fashion accessory.

In the above method the base side of the trapezoidal piece of material is slightly longer than the vertical side. Also, the length of the vertical side in the method is between 26 and 46 inches.

The fabric fashion accessory of the present invention, for use as a scarf or sash, is made according to the method of the present invention and comprises a two-ply triangle of material having (1) a right angle corner of 90 degrees, the right angle corner having been formed during the fourth step of the method of the present invention and having an acute corner of more than 45 degrees but less than 90 degrees, which acute corner also was formed during the fourth step of the same method, (2) a tapered corner of less than 45 degrees but greater than 0 degrees, the tapered corner having been formed during the fourth step of the method of the present invention, (3) a finished vertical side, extending between the acute corner and the right angle corner, the finished vertical side having been formed during the fourth and sixth steps of the method of the present invention, (4) a finished diagonal side, extending between the acute corner and the tapered corner, the finished diagonal side having been formed during the fourth, fifth and sixth steps of the method of the present invention, (5) a finished base side, extending between the tapered corner and the right angle corner, the finished base side having been formed during the fourth and sixth steps of the method of the present invention, (6) a seam, formed during the third and sixth steps of the method of the present invention, which seam extends from the juncture point of the top corner and the base corner, to the right angle corner. The juncture point lies in the finished diagonal side.

The sides of the two-ply triangle of material, of the fabric fashion accessory of the present invention, are interwoven along the finished vertical side and the finished base side and sewn along the finished diagonal side and the seam. The sewing or stitching of the fabric the two-ply triangle of material inside out during the sixth step of the method of the present invention.

In the preferred embodiment of the fabric fashion accessory of the present invention, the finished vertical side is disposed at a right angle to the finished base side and the seam is disposed at a right angle to the finished diagonal side.

Also, in the preferred embodiment of the fabric fashion accessory of the present invention, the length of the portion of the finished diagonal side which extends between the acute corner and the juncture point is approximately one-fourth the length of the portion of the finished diagonal side which extends between the juncture point and the tapered corner.

The seam of the fabric fashion accessory of the present invention ranges between 13 and 23 inches in length, depending upon the desired overall size of the accessory.

OBJECTIVES OF THE INVENTION

The objectives of the present invention are to provide a fabric fashion accessory, for use as a scarf or as sash, which is:

(1) light weight but has more body and a more finished look than conventional scarves and sashes;

(2) easy to tie, especially for a handicapped or left handed person;

(3) shaped for readily creating a tying loop;

(4) rotatable around the neck in a variety of positions;

(5) more stretchable than conventional scarves;

(6) adaptable to modern styles;

(7) graceful in appearance and does not pucker when folded;

(8) easy to remove from the neck or waist of the person.

BRIEF DESCRIPTION OF THE DRAWINGS

FIG. 13 shows the same accessory as a scarf tied about the neck as a dickey or fill-in.

DETAILED DESCRIPTION OF THE PREFERRED EMBODIMENT OF THE INVENTION

Figure 1:
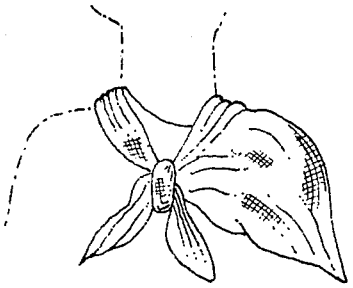
FIG. 1 is a pespective view from the front showing the finished accessory of the present invention draped as a scarf on the left side of the wearer.

The fabric fashion accessory of the present invention is a light, graceful and flowing scarf or sash and is more stylish and versatile for today's fashions than prior art accessories. Throughout the following detailed description of the method and accessory of the present invention, like reference numerals are used to denote like parts disclosed in the accompanying drawings, FIGS. 1–18. As shown in FIG. 1 and FIGS. 9–18, the accessory offers a large variety of currently popular ties for use as a scarf or sash.

The method of the present invention is described first as the method for making the accessory provides the unique characteristics of the finished fashion accessory. Cutting the material on a bias provides the stretchability; the relative dimensions and shape of the initial cut provides the many tying options; the location of the sewing or stitches enhances the ease of tying; the use of dual layers of material adds body and grace to the finished product and reversal of the material surfaces adds beauty and grace to the accessory and hides the stitching at the same time.

Figure 2:
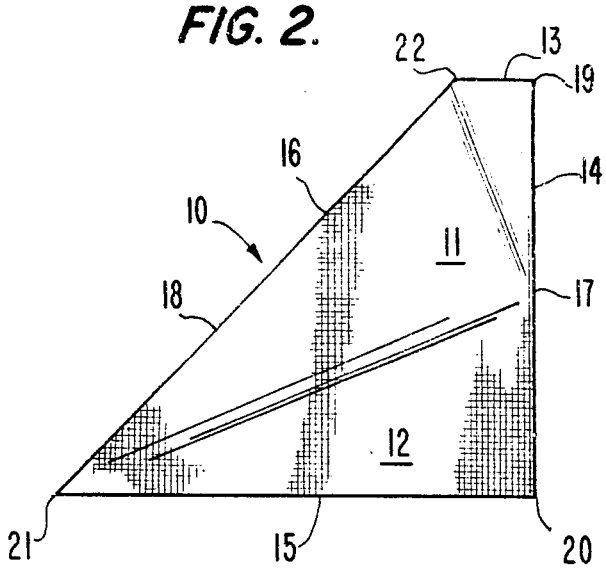
FIG. 2 is a front elevational view of the material of the present invention after being cut into a trapezoidal piece before assembling the accessory. The rear elevational view is a mirror image of the front.
Figure 7:
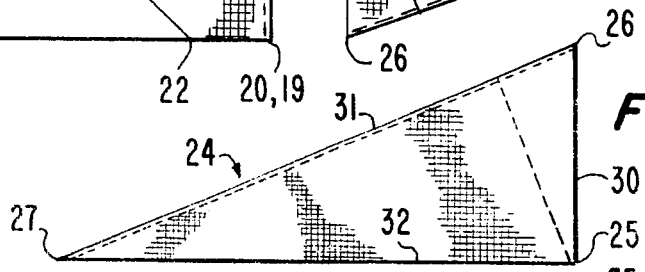
FIG. 7 is a plan view of the finished accessory of the present invention after the two-ply triangle of material has been turn inside out and the small opening stitched closed.
Figure 8:
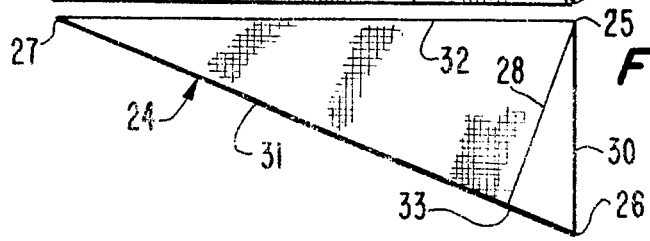
FIG. 8 is a plan view of the reverse side of the finished accessory as shown in FIG. 7.
Figure 9:
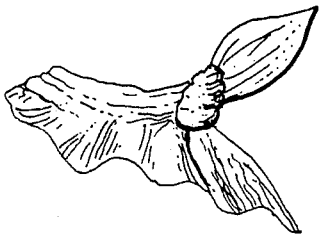
FIG. 9 shows the accessory of the present invention draped as a scarf to the left.
Figure 10:
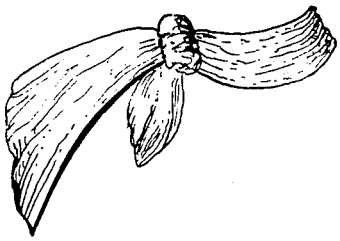
FIG. 10 shows the same accessory with the tie of FIG. 9 but draped as a scarf to the right.
Figure 11:
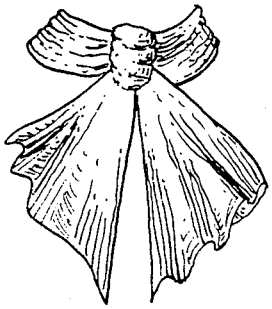
FIG. 11 shows the same accessory as a scarf giving a split tie effect by tying the accessory through the middle.
Figure 12:
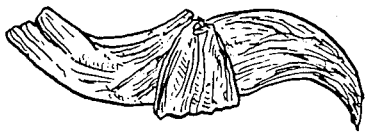
FIG. 12 shows the same accessory as a scarf with the large triangular end pulled through loop made in the small end with the tie flowing towards the back.
Figure 13:
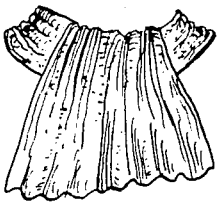
Figure 14:
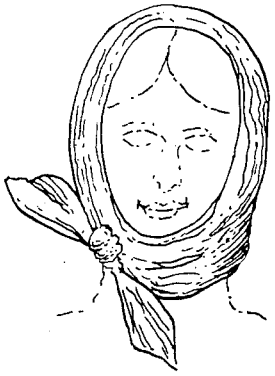
FIG. 14 shows the same accessory worn as a head scarf.
Figure 15:
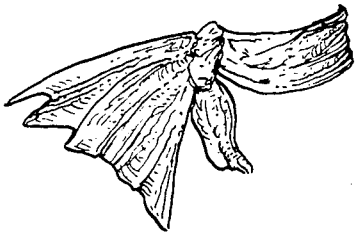
FIG. 15 shows the same accessory worn as a scarf with both ends tied together to flow over the shoulder.
Figure 16:
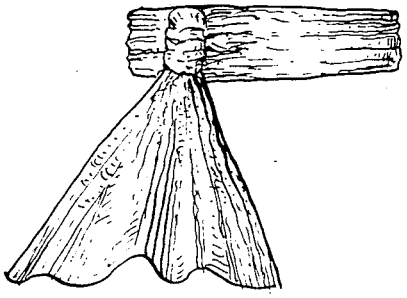
FIG. 16 shows the same accessory as a sash with the tie at the end.
Figure 17:
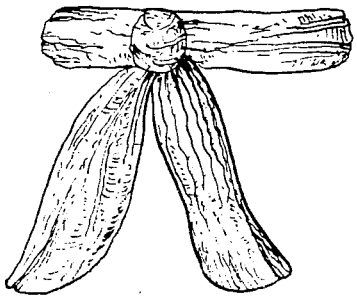
FIG. 17 shows the same accessory as a sash with the tie through the middle of the large triangular end.
Figure 18:
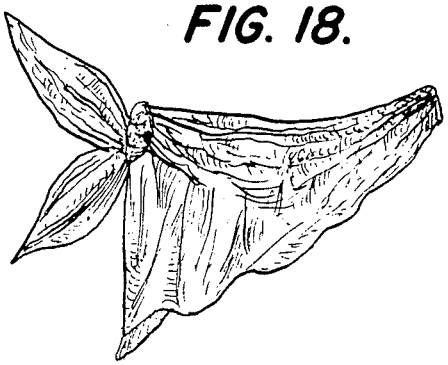
FIG. 18 shows the same accessory as a sash with just the ends tied together.

The method for making the fabric fashion accessory of the present invention, for use as a scarf or sash, comprises the following eight steps:

First: A trapezoidal piece of material, as shown generally at reference numeral 10, is cut from a material such as pure silk or polyester. Material 45 inches square permits making two scarves from the same square of material. Dimensions are critical only in relation to each other. Preferably, the finished accessory, at completion, equates to an equilateral triangle folded lengthwise from its apex to its base, resulting in a two-ply right triangle, as shown in FIGS. 7 and 8. As best illustrated in FIG. 2, the cutting results in a trapezoidal piece of material 10 having an upper portion 11, a lower portion 12, a top side 13, a vertical side 14, a base side 15 and a first diagonal side 16. Vertical side 14 has a vertical midpoint 17 and first diagonal side 16 has a diagonal midpoint 18.

Top side 13 and vertical side 14 meet at right angles to each other, forming a top corner 19., Vertical side 14 and base side 15 meet at right angles to each other, forming a base corner 20. Base side 15 and first diagonal side 16 meet at an angle of less than 90 degrees in relation to base side 15, forming a lower corner 21 and top side 13 meets first diagonal side 16 at an angle greater than 90 degrees in relation to top side 13, forming an upper corner 22. The length of top side 13 is given in terms of the relative lengths of first diagonal side 16 and base side 15 by the formula: length of top side 13 equals the length of first diagonal side 16 minus the length of base side 15. Preferably, the cut along first diagonal side 16 should be made at 45 degrees, in relation to base side 15, to provide maximum stretchability for the finished accessory. This bias cut is the secret of the flowing effect in the finished scarf or sash and permits the accessory to fall gracefully around the head, shoulders or body when worn.

Figure 3:
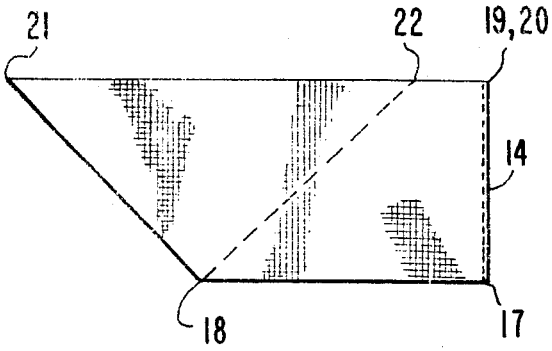
FIG. 3 is a plan view of the material of the present invention after folding the lower portion of the material over the upper portion and after sewing the edges of the upper one-half and the lower one-half of the vertical side to each other.
Figure 4:
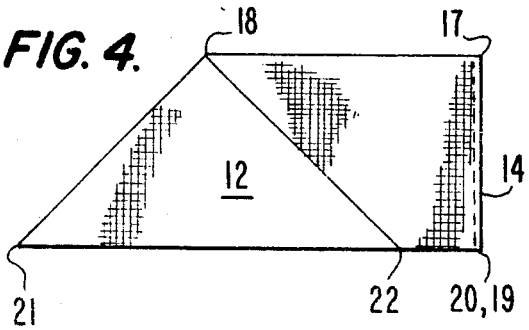
FIG. 4 is a plan view of the reverse side of the material as shown in FIG. 3.

Second: As best illustrated in FIG. 3, lower portion 12 of trapezoidal piece of material 10 is then folded forwardly and upwardly, along an imaginary line drawn between diagonal midpoint 18 of first diagonal side 16 and vertical midpoint 17 of vertical side 14, so that base corner 20 and top corner 19 are aligned, top corner 19 being behind base corner 20 and the upper one-half of vertical side 14 is behind, and aligned with, the lower one-half of vertical side 14. FIG. 3 shows trapezoidal piece of material 10, during this step, as it would appear to the assembler of the accessory, from the front or top side, if the assembly was laid down on a table. FIG. 4 shows the same assembly during this step, but from the reverse, or underside of the assembly.

Third: As best illustrated in FIG. 3 and 4, the edges of the upper one-half and the lower one-half of vertical side 14 next are sewn to each other.

Figure 5:
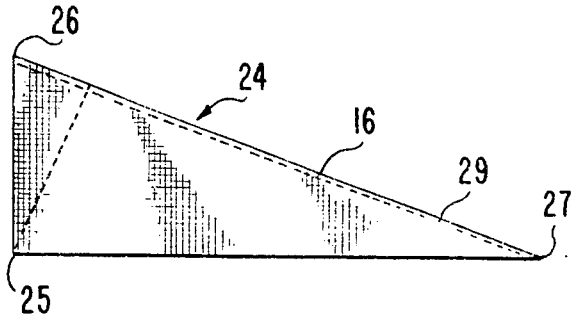
FIG. 5 is a plan view of the material of the present invention after the second folding which creates a second diagonal side and after sewing the edges of the first diagonal side and second diagonal side to each other leaving a small opening shown to the right.
Figure 6:
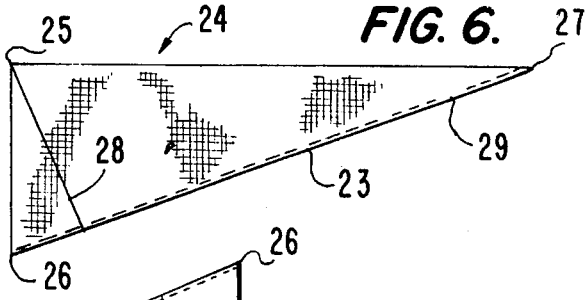
FIG. 6 is a plan view of the reverse side of the material as shown in FIG. 5, showing the position of the seam.

Fourth: As shown in FIG. 5, a second diagonal side 23, is next created by folding trapezoidal piece of material 10 so that top corner 19 and base corner 20, sewn together in the preceding step (third), lie along first diagonal side 16 and parallel thereto, thus forming a two-ply triangle of material, shown generally at reference numeral 24. The resulting two-ply triangle of material 24 has a right angle corner 25 of 90 degrees, and acute corner 26 of more than 45 degrees but less than 90 degrees, and a tapered corner 27 of less than 45 degrees but greater than 0 degrees. FIG. 5 shows one side of the assembly during this step and FIG. 6 shows the reverse side (including seam 28 resulting from the sewing in the third step).

Fifth: As also illustrated in FIGS. 5 and 6, the edge of fist diagonal side 16 is next sewn to the edge of second diagonal side 23, from tapered corner 27 to acute corner 26, leaving an opening 29 approximately one-inch in length in the sewing. Ideally, opening 29 in the sewing should be located about five inches from tapered corner 27.

Sixth: Next two-ply triangle of material 24 is turned inside out by pulling the interior of the fabric fashion accessory through opening 29 left in the sewing during the previous (fifth) step above. This reversal of the material surfaces conceals the sewn edges of first diagonal side 16 and second diagonal side 23 and the sewn edges of the lower one-half and the upper one-half of vertical side 14. FIGS. 7 and 8 illustrate the two outer surfaces of the finished accessory of the present invention after reversal operation. FIG. 8 shows the final position of the seam 28 which was created by sewing the lower one-half of vertical side 14 to the upper one-half of vertical side 14 during the third step above. This seam 28 is away from the lengthy tapered corner 27 so that this latter corner is not bulky when tied in loops for many of the wearing options shown in FIGS. 9-18.

Seventh: As illustrated in FIG. 7, opening 29, previously left in the sewing during the fifth step, is now stitched closed, so that the closure of the accessory from tapered corner 27 to acute corner 26 is complete.

Eighth: The final step in the manufacture of the fabric fashion accessory of the present invention is to press two-ply triangle of material 24 at a pressing iron temperature suitable for the particular fabric being used to make the accessory.

In the above described method, base side 15 of trapezoidal piece of material 10 is slightly longer than vertical side 14. Also, the length of vertical side 14, in the method, is between 26 and 46 inches depending upon the overall size of accessory desired. When using 45 inch material stock, the approximate dimensions of the trapezoidal piece of material 10 which is most economical to cut is as follows:

top side 13–9½ inches;
vertical side 14–36 inches;
base side 15–39 inches;
first diagonal side 46½ inches.

As best shown in FIGS. 7 and 8, the fabric fashion accessory of the present invention, for use as a scarf or sash, is made according to the method of the present invention and comprises a two-ply triangle 24 having a right angle corner 25 of 90 degrees, this corner having been formed during the fourth step of the method of the present invention, and an acute corner 26 of more than 45 degrees but less than 90 degrees, this corner also having been formed during the fourth step of the method of the present invention, and a tapered corner 27 of less than 45 degrees but greater than 0 degrees, this corner having been formed during the fourth step of the method of the present invention, and a finished vertical side 30, extending between acute corner 26 and right angle corner 25, finished vertical side 30 having been formed during the fourth and sixth steps of the method of the present invention, and a finished diagonal side 31, extending between acute corner 26 and tapered corner 27, finished diagonal side 31 having been formed during the fourth, fifth and sixth steps of the method of the present invention, and a finished base side 32, extending between tapered corner 27 and right angle corner 25, finished base side 32 having been formed during the fourth and sixth steps of the method of the present invention, and a seam 28, formed during the third and sixth steps of the method of the present invention. Seam 28 extends from the juncture point 33 of top corner 19 and base corner 20 to the apex of right angle corner 25. Juncture point 33 lies in the finished diagonal side 31 of the completed fabric fashion accessory of the present invention.

The sides of the two-ply triangle of material 24, of the the fabric fashion accessory of the present invention, are interwoven along finished vertical side 30 and finished base side 32 and sewn along finished diagonal side 31 and seam 28. However, the stitches of the fabric fashion accessory of the present invention are cleverly concealed by turning the two-ply triangle of material 24 inside out during the sixth step of the method of the present invention.

In the preferred embodiment of the fabric fashion accessory of the present invention, finished vertical side 30 is disposed at a right angle to finished base side 32 and seam 28 is disposed at a right angle to finished diagonal side 31. It is possible, without departing from the principles of the present invention, to have the angle of these dispositions vary, particularly if the cutting during the first step of the method of the present invention was not accurate in dimensions, angles or both.

Also, in the preferred embodiment of the fabric fashion accessory of the present invention, the length of the portion of finished diagonal side 31, which extends between acute corner 26 and juncture point 33 is approximately one-fourth the length of the portion of finished diagonal side 31 which extends between juncture point 33 and tapered corner 27.

Seam 28 of the present invention ranges between 13 and 23 inches in length, depending upon the the desired overall size of the fabric fashion accessory.

I claim:

1. A method for making the fabric fashion accessory for use as a scarf or sash, comprising the steps of:

First: cutting a trapezoidal piece of material having
an upper portion,
a lower portion,
a top side,
a vertical side having a vertical midpoint,
a base side,
a first diagonal side having a diagonal midpoint, wherein
said top side and said vertical side meet at right angles to each other, forming a top corner,
said vertical side and said base side meet at right angles to each other, forming a base corner,
said base side and said first diagonal side meet at an angle of less than 90 degrees in relation to said base side, forming a lower corner,
said top side meets said first diagonal side at an angle of greater than 90 degrees in relation to said top side, forming an upper corner,
the length of said top side is given in terms of the relative lengths of said first diagonal side and said base side by the formula: length of said top side equals the length of said first diagonal side minus the length of said base side; Second: folding said lower portion of said trapezoidal piece of material, forwardly and upwardly, along an imaginary line drawn between said diagonal midpoint and said vertical midpoint, so that said base corner and said top corner are aligned, said top corner being behind said base corner and the upper one-half of said vertical side is behind and aligned with the lower one-half of said vertical side;

Third: sewing the edges of said upper one-half and said lower one-half of said vertical side to each other;

Fourth: creating a second diagonal side by folding said trapezoidal piece of material so that said top corner and said base corner, sewn together in the preceding step, lie along said first diagonal side and parallel thereto, thus forming a two-ply triangle of said material which triangle has a right angle corner of 90 degrees, an acute corner of more than 45 degrees but less than 90 degrees and a tapered corner of less than 45 degrees but greater than 0 degrees;

Fifth: sewing the edge of said first diagonal side to the edge of said second diagonal side from said tapered corner to said acute corner, leaving an opening approximately one-inch in length in said sewing, said opening to be located about five inches from said tapered corner;

Sixth: turning said two-ply triangle of material inside out by pulling the interior of said fabric fashion accessory through said opening, to conceal the sewn edges of said first diagonal side and said second diagonal side and of said lower one-half and said upper one-half of said vertical side;

Seventh: stitching closed said opening previously left in said sewing;

Eighth: pressing said two-ply triangle of material at a pressing iron temperature suitable for the particular fabric being used to make said fabric fashion accessory.

2. The method of claim 1 wherein said base side is slightly longer than said vertical side.

3. The method of claim 1 wherein the length of said vertical side is between 26 and 46 inches.

4. A fabric fashion accessory, for use as a scarf or sash, said accessory made according to the method of claim 1, and comprising:

a two-ply triangle of material having a right angle corner of 90 degrees, said right angle corner having been formed during the fourth step of said method of claim 1, an acute corner of more than 45 degrees but less than 90 degrees, said acute corner having been formed during the fourth step of said method of claim 1, a tapered corner of less than 45 degrees but greater than 0 degrees, said tapered corner having been formed during the fourth step of said method of claim 1, a finished vertical side, extending between said acute corner and said right angle corner, said finished vertical side having been formed during the fourth and sixth steps of said method of claim 1, a finished diagonal side, extending between said acute corner and said tapered corner, said finished diagonal side having been formed during the fourth, fifth and sixth steps of said method of claim 1, a finished base side, extending between said tapered corner and said right angle corner, said finished base side having been formed during the fourth and sixth steps of said method of claim 1, a seam, formed during the third and sixth steps of said method of claim 1, extending from the juncture point of said top corner and said base corner, which juncture point lies in said finished diagonal side, to said right angle corner, wherein the sides of the said two-ply triangle of material are interwoven along said finished vertical side and said finished base side and sewn along said finished diagonal side and said seam, which stitching is concealed by turning said two-ply triangle of material inside out during the sixth step of said method of claim 1.

5. The fabric accessory of claim 4 wherein said finished vertical side is disposed at a right angle to said finished base side and said seam is disposed at a right angle to said finished diagonal side.

6. The fabric accessory of claim 5 wherein the length of the portion of said finished diagonal side which extends between said acute corner and said juncture point is approximately one-fourth the length of the portion of said finished diagonal side which extends between said juncture point and said tapered corner.

7. The fabric fashion accessory of claim 6 wherein said seam is between 13 and 23 inches in length.

* * * * *